US012758814B1

(12) United States Patent
Benoit et al.

(10) Patent No.: US 12,758,814 B1
(45) Date of Patent: Oct. 13, 2026

(54) BARBELL SUPPORT DEVICE AND SYSTEM FOR CALF RAISE EXERCISES

(71) Applicant: Exponent Edge Inc., Charlotte, NC (US)

(72) Inventors: Jason Benoit, Charlotte, NC (US); Adrian Draghici, Charlotte, NC (US)

(73) Assignee: EXPONENT EDGE INC, Charlotte, NC (US)

( * ) Notice: Subject to any disclaimer, the term of this patent is extended or adjusted under 35 U.S.C. 154(b) by 0 days.

(21) Appl. No.: 19/186,452

(22) Filed: Apr. 22, 2025

Related U.S. Application Data

(60) Provisional application No. 63/637,035, filed on Apr. 22, 2024.

(51) Int. Cl.
*A63B 21/078* (2006.01)
*A63B 23/08* (2006.01)

(52) U.S. Cl.
CPC ..... *A63B 21/0783* (2015.10); *A63B 23/085* (2013.01); *A63B 2208/0204* (2013.01)

(58) Field of Classification Search
CPC ..... A63B 21/0783; A63B 21/4027; A63B 21/4045; A63B 23/08; A63B 23/085; A63B 2208/0204; A63B 2244/09
See application file for complete search history.

(56) References Cited

U.S. PATENT DOCUMENTS

| | | | | |
|---|---|---|---|---|
| 3,190,648 | A * | 6/1965 | Kallenbach | A63B 21/0783 482/106 |
| D892,239 | S * | 8/2020 | Carmichael | D21/694 |
| D954,867 | S * | 6/2022 | Carmichael | D21/694 |
| 2019/0247701 | A1* | 8/2019 | Sergakis | A63B 21/078 |
| 2019/0308061 | A1* | 10/2019 | Murrell | A63B 71/0054 |
| 2020/0038704 | A1* | 2/2020 | Adams | A63B 21/0626 |
| 2022/0203153 | A1* | 6/2022 | Sergakis | A63B 21/078 |
| 2022/0219035 | A1* | 7/2022 | Esco | A63B 21/0724 |
| 2023/0123730 | A1* | 4/2023 | Downing | A63B 71/0036 482/104 |
| 2024/0307731 | A1* | 9/2024 | Meredith | A63B 17/02 |

FOREIGN PATENT DOCUMENTS

| | | | | |
|---|---|---|---|---|
| CN | 114053656 A * | 2/2022 | | A63B 21/075 |

* cited by examiner

*Primary Examiner* — Gary D Urbiel Goldner
(74) *Attorney, Agent, or Firm* — Avek IP, LLC

(57) ABSTRACT

A barbell support device includes a main bracket supporting a bottom hook, the bottom hook providing a surface to support a barbell thereon; a bar retainer removably secured to the bottom hook such that an elongated guide channel is created by the bar retainer and the bottom hook in which the barbell can vertically move; a rear bracket extending from the main bracket and to engage with a vertical post; and a pin extending from the main bracket and to insert into an aperture of the vertical post; the barbell support device is to support the barbell as a user completes an exercise.

9 Claims, 6 Drawing Sheets

BARBELL SUPPORT DEVICE AND SYSTEM FOR CALF RAISE EXERCISES

RELATED APPLICATIONS

This application claims priority to U.S. Provisional Application No. 63/637,035, filed Apr. 22, 2024, the foregoing incorporated by reference in its entirety herein.

FIELD OF INVENTION

The disclosure relates generally to exercise equipment. More specifically, the disclosure relates to a barbell support device and system that is configured to guide a barbell during calf raise exercises, such that the barbell and the vertical posts are protected from damage.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a barbell support device, comprising a main bracket supporting a bottom hook, the bottom hook providing a surface to support a barbell thereon; a bar retainer removably secured to the bottom hook such that an elongated guide channel is created by the bar retainer and the bottom hook in which the barbell can vertically move; a rear bracket extending from the main bracket and configured to engage with a vertical post; and a pin extending from the main bracket and configured to insert into an aperture of the vertical post. The barbell support device configured to support a barbell as a user completes an exercise.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

LIST OF REFERENCES

100—Barbell Support Device
102—Bar Retainer
104—Bottom Hook

106—Main Vertical Bracket
108—Rear Bracket
110—Pin
112—Rack Hole Adapter
114—Securing Device(s)
116—Bottom Insert Bar
118—Top Insert Bar
120—Aperture
122—Safety Pin
124—First Side of Brace
126—Second Side of Brace
128—Insert
130—Base Surface
132—Lip
134—Top Bar Opening
200—First Side of Rear Bracket
202—Second Side of Rear Bracket
204—Back Surface of Main Vertical Bracket
206—Gripping Pad
208—Bottom Bar Opening
300—Elongated Guide Channel

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. One common exercise is a calf raise, which is a lower body exercise that works the calf muscles. The user will generally lift their heels off of the ground, either with their feet flat or with their toes/forward portion of their foot elevated. Commonly, a user will place weight (such as a barbell) on their shoulders to increase resistance.

The present invention provides for a barbell support device and system, wherein a pair of support devices may be provided for securing to a pair of vertical posts. The devices act to (1) protect the barbell and vertical posts from damage; and (2) improve a user's balance during performing of calf raises. Each support device provides an elongated guide channel, wherein the barbell can rest within the channel and vertically move within the channel as the user performs a calf raise exercise. The support device is removably securable to a post such that a height of the device can be selected to fit the user. In addition, each device may be used as a standard J hook, thereby providing additional functions to support a user's needs.

Figure 1:
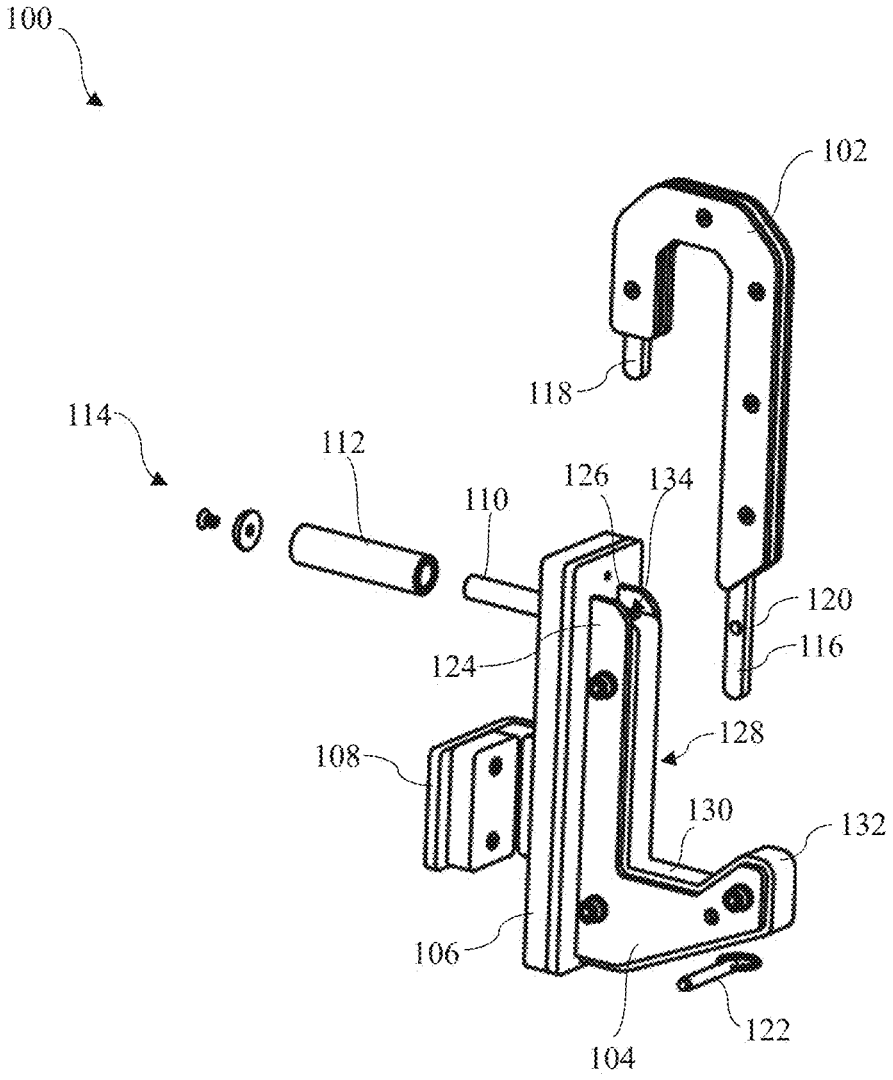
FIG. 1 is a perspective, disassembled view of a barbell support device in accordance with the present invention.
Figure 2:
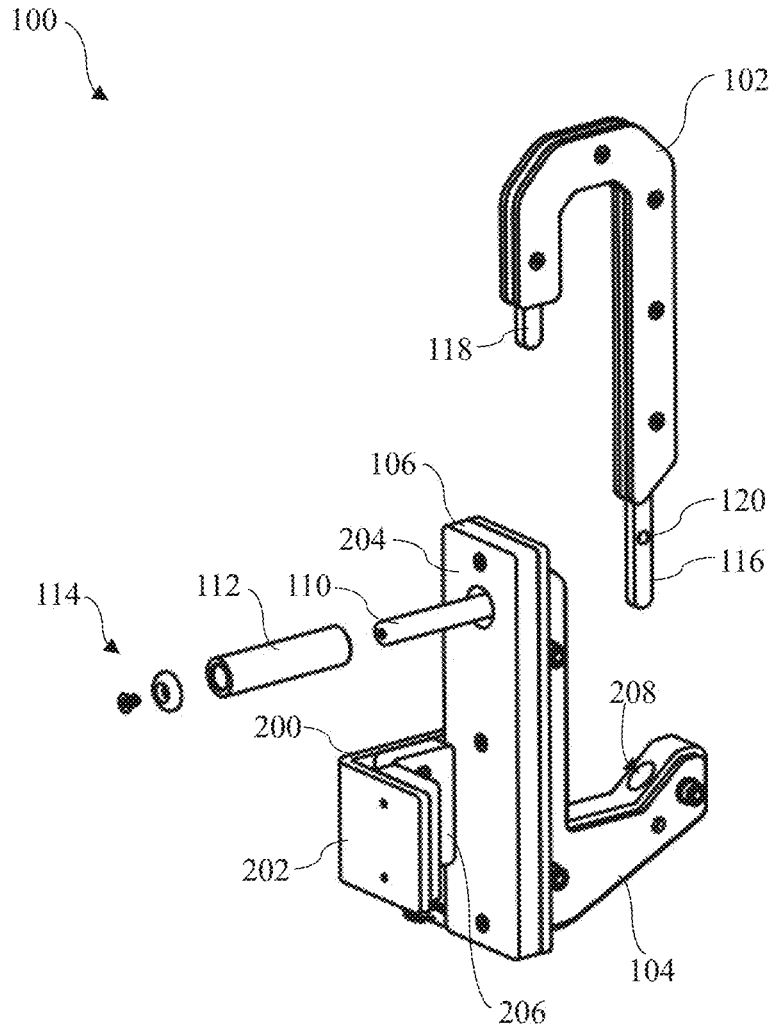
FIG. 2 is another perspective, disassembled view of the barbell support device of FIG. 1.
Figure 3:
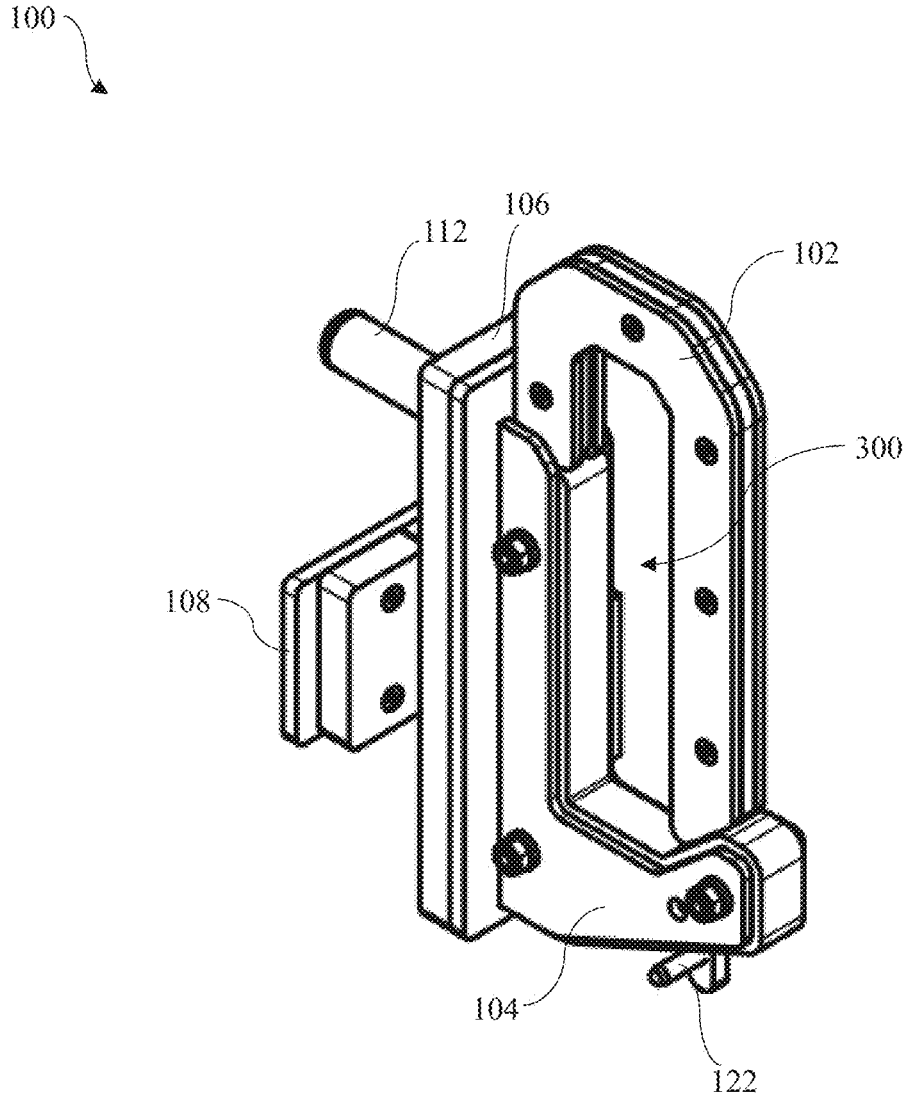
FIG. 3 is a perspective, assembled view of the barbell support device of FIG. 1.
Figure 4:
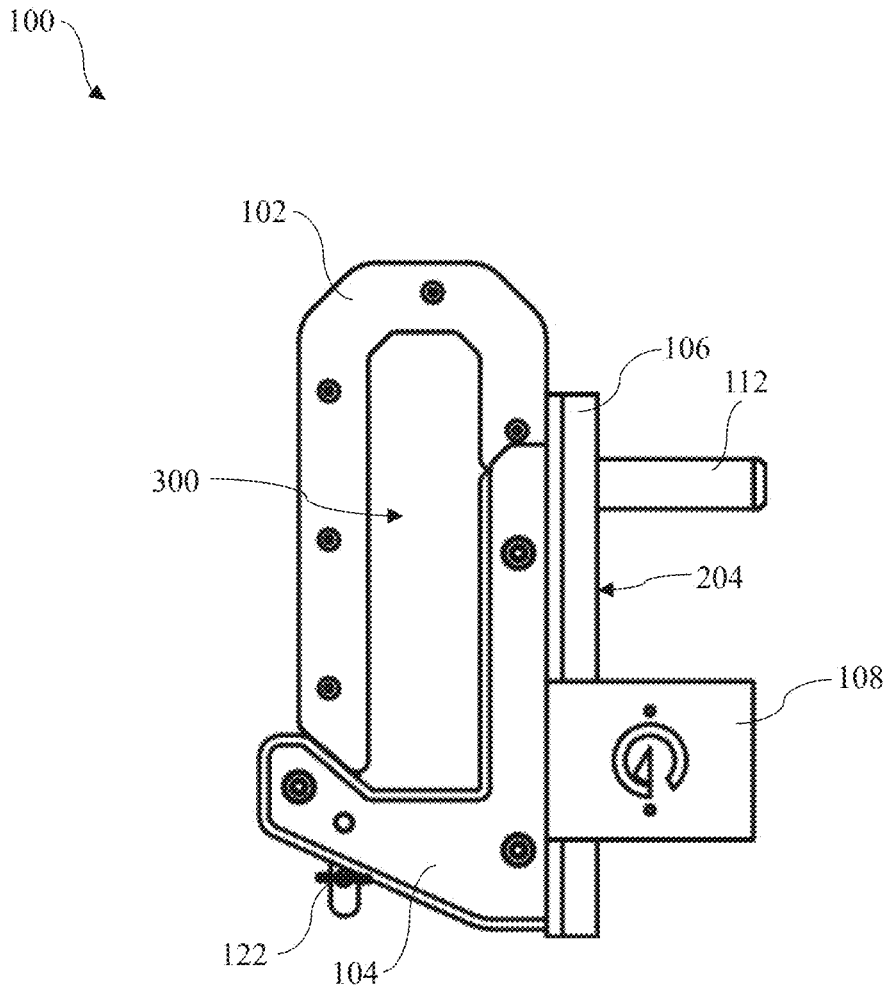
FIG. 4 is a side view of the barbell support device of FIG. 1.
Figure 5:
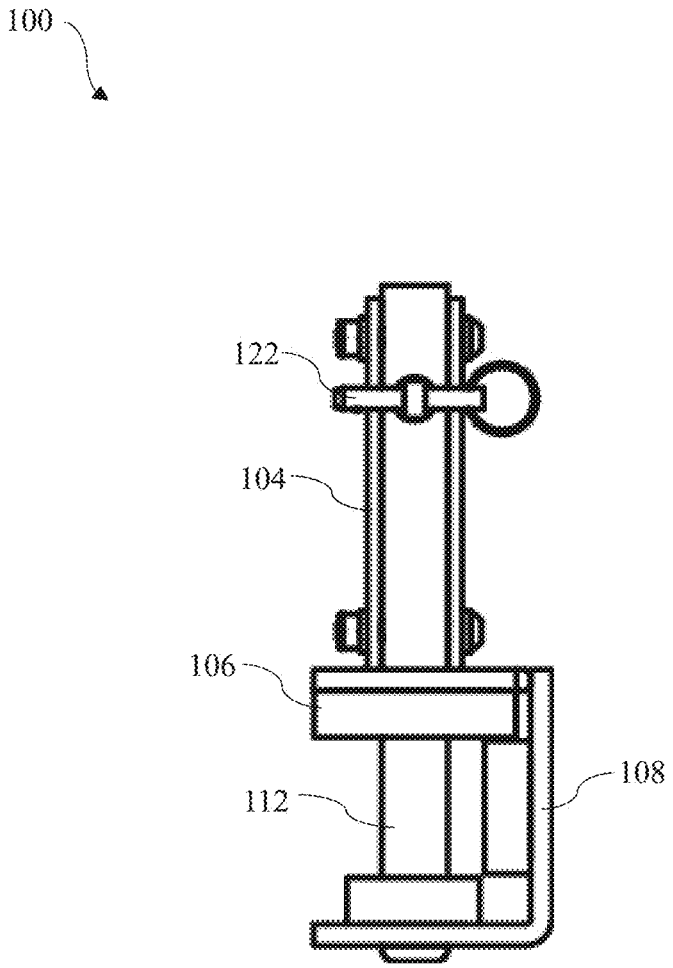
FIG. 5 is a bottom view of the barbell support device of FIG. 1.
Figure 6:
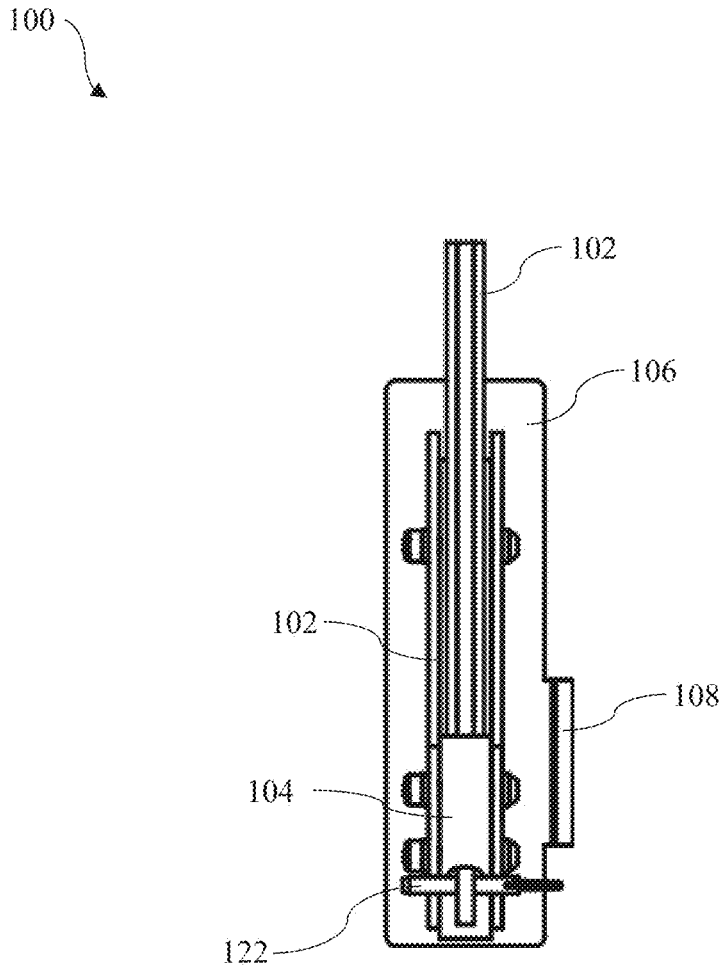
FIG. 6 is a front view of the barbell support device of FIG. 1.

In FIGS. 1 through 6, a barbell support device 100 is shown in accordance with the present invention. The barbell support device 100 includes a bar retainer 102 removably engaged with a bottom hook 104. The bottom hook 104 is specifically a J-hook, and can function for conventional J-hook uses without the bar retainer 102, as desired by the user. In other words, the user can simply remove the bar retainer 102 and utilize the bottom hook 104 to support a barbell at a desired height. The bar retainer 102 is in the shape of an inverted "J". The exact shape and dimensions may vary so long as the bottom hook 104 is shaped to properly support a bar, while the bar retainer 102 is configured to create an enclosed channel.

The bottom hook 104 is supported by a main vertical bracket 106, which also supports a rear bracket 108 and a pin 110 extending in a direction opposite of the bottom hook 104. Although the exact design can vary, the brackets are used to lock the device against a vertical post at a selected height. The rear bracket 108 will wrap substantially around the post, while the pin 110 inserts through a selected aperture on the post. Vertical posts are conventional in a plurality of exercise equipment, though there can be some variation in size. The pin 110 has a first diameter, which may be suitable for some posts, though it is contemplated that a rack hole adapter 112 may be added to alter the size of the pin 110 such that the device 100 may be used with varying vertical posts. Securing devices 114 can be utilized to retain the adapter 112 to the pin 110.

The bar retainer 102 includes a bottom insert bar 116 and a top insert bar 118, both extending substantially in a downward direction. These bars 116, 118 are configured to insert into the bottom hook 104 to secure the two elements together. The bottom insert bar 116 further includes an aperture 120 for receiving a safety pin 122 once the bar retainer 102 is coupled to the bottom hook 104 as shown best in FIGS. 3 and 4. As shown, the safety pin 122 may insert through the aperture 120 below the bottom hook 104, thereby preventing the bar retainer 102 from being removed until the pin 122 is removed.

The bottom hook 104 includes a brace having a first side 124 and a second side 126 with an insert 128 positioned therebetween. The insert 128 may be composed of a flexible material, such as padding, that will protect the barbell positioned therein. The insert 128 and brace form a base surface 130 for receiving and supporting a barbell and further include a lip 132 for preventing the barbell from falling from the base surface 130.

The bottom hook 104 also includes a top bar opening 134 and a bottom bar opening 208 to receive the insert bars 116, 118 as the bar retainer 102 and bottom hook 104 come together. This creates a nesting function between the bar retainer 102 and the bottom hook 104.

The rear bracket 108 includes a first side 200 and a second side 202 and can optionally include a gripping pad 206 for increasing grip against the vertical post. The rear bracket 108 can vary in size as would be appropriate to fit a variety of vertical posts.

The pin 110 and the rear bracket 108 extend from a back surface 204 of the main vertical bracket 106, again in a direction substantially opposite of the bottom hook 104.

The bottom hook 104 and the bar retainer 102 come together to form an elongated channel 300. This channel 300 is specifically designed in dimensions to provide enough space for the barbell to move therein as the user performs calf raise exercises. The exact dimensions and materials of the device 100 can vary based on aesthetical, functional, or manufacturing considerations. The use of two devices 100 in connection with a rack system and a barbell will allow for the barbell to remain within the elongated channels such that the user remains within a narrow plane of vertical motion and does not tilt too far forward or backward. The use of the devices protects both the vertical posts and the barbell.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A barbell support device, comprising:

a main bracket supporting a bottom hook, the bottom hook providing a surface configured to support a barbell thereon;

a bar retainer removably secured to the bottom hook such that an elongated guide channel is created by the bar retainer and the bottom hook, the elongated guide channel being configured to enable the barbell to vertically move therewithin;

a rear bracket extending from the main bracket and configured to engage with a vertical post; and a pin extending from the main bracket and configured to insert into an aperture of the vertical post;

wherein the barbell support device is configured to support the barbell as a user completes an exercise.

2. The barbell support device of claim 1, wherein the bar retainer and bottom hook come together such that the elongated guide channel is fully enclosed.

3. The barbell support device of claim 1, further comprising:

a top insert bar extending from the bar retainer;

a bottom insert bar extending from the bar retainer;

a top opening extending into the bottom hook; and a bottom opening extending into the bottom hook;

wherein the top insert bar removably secures into the top opening and the bottom insert bar removably secures into the bottom opening such that the bar retainer is removably secured to the bottom hook.

4. The barbell support device of claim 3, further comprising a safety pin configured to extend through the bottom insert bar when the bottom insert bar is inserted into the bottom opening, wherein the safety pin prevents removal of the bar retainer from the bottom hook when inserted.

5. The barbell support device of claim 1, further comprising a rack hole adapter configured to secure around the pin to adapt the pin.

6. The barbell support device of claim 1, wherein the bottom hook further comprises a lip extending upward from the surface, the lip configured to retain the barbell on the surface.

7. The barbell support device of claim 1, wherein the bottom hook further comprises a brace having a first side and a second side and an insert extending between the first side and the second side.

8. The barbell support device of claim 1, further comprising a gripping pad secured to the rear bracket.

9. The barbell support device of claim 1, wherein the bar retainer has a shape of an inverted J.

* * * * *